US009593515B2

(12) United States Patent
Rosales et al.

(10) Patent No.: US 9,593,515 B2
(45) Date of Patent: Mar. 14, 2017

(54) MOTOR VEHICLE LOCK

(71) Applicant: Brose Schliesssysteme GmbH & Co. KG, Wuppertal (DE)

(72) Inventors: David Rosales, Rochester Hills, MI (US); Michael Wittelsbuerger, Lake Orion, MI (US); Stepan Hanke, Lake Orion, MI (US)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 0 days.

(21) Appl. No.: 14/884,552

(22) Filed: Oct. 15, 2015

(65) Prior Publication Data

US 2016/0108649 A1 Apr. 21, 2016

Related U.S. Application Data

(60) Provisional application No. 62/065,436, filed on Oct. 17, 2014.

(51) Int. Cl.

| | |
|---|---|
| ***E05C 3/02*** | (2006.01) |
| ***E05B 85/24*** | (2014.01) |
| ***E05B 77/38*** | (2014.01) |
| ***E05B 85/04*** | (2014.01) |
| ***E05B 79/10*** | (2014.01) |
| *E05B 77/40* | (2014.01) |
| *E05B 85/26* | (2014.01) |

(52) U.S. Cl.

CPC ..... *E05B 85/243* (2013.01); *E05B 77/38* (2013.01); *E05B 79/10* (2013.01); *E05B 85/045* (2013.01); *E05B 77/40* (2013.01); *E05B 85/26* (2013.01)

(58) Field of Classification Search

CPC ..... E05B 85/243; Y10T 292/1047

USPC ..... 292/216, DIG. 38, DIG. 56, DIG. 73

See application file for complete search history.

(56) References Cited

U.S. PATENT DOCUMENTS 4,756,564 A 7/1988 Ikeda et al.

FOREIGN PATENT DOCUMENTS

| | | |
|---|---|---|
| DE | 10216313 | 10/2003 |
| DE | 202012011372 | 3/2014 |
| EP | 1516986 | 3/2005 |
| GB | 2192423 | 1/1988 |
| JP | 2003293638 | 10/2003 |

(Continued)

OTHER PUBLICATIONS

"Extended European Search Report," for European Patent Application No. 15179085.4 related to co-pending U.S. Appl. No. 14/884,552, mailed Oct. 7, 2015 (8 pages).

*Primary Examiner* — Matthew Ing

(74) *Attorney, Agent, or Firm* — Pauly, Devries Smith & Deffner, LLC

(57) ABSTRACT

The application is directed at a motor vehicle lock, wherein a lock latch, a pawl, and a lock striker bracket, which lock striker bracket comprises a latch bar and a frame bar, are provided, wherein the lock latch is or may be brought into holding engagement with the latch bar, wherein a closing cycle of the motor vehicle lock involves moving the lock latch from the open position to the at least one latching position, wherein the pawl may fall into at least one engagement position, in which it is in blocking engagement with a preliminary latching detent or a main latching detent of the lock latch for blocking the lock latch in its preliminary latching position or its main latching position, wherein the pawl may be deflected into at least one release position, in which it releases the lock latch.

20 Claims, 9 Drawing Sheets

(56) References Cited

FOREIGN PATENT DOCUMENTS

WO 2010129683 11/2010

MOTOR VEHICLE LOCK

CLAIM OF PRIORITY

This application claims the benefit of U.S. Provisional Application No. 62/065,436, filed Oct. 17, 2014, the content of which is herein incorporated by reference in its entirety.

FIELD OF THE INVENTION

The application is directed at a motor vehicle lock.

BACKGROUND

The motor vehicle lock in question can in particular be assigned to a motor vehicle door. The expression "motor vehicle door" is to be understood in a broad sense. It includes in particular side doors, back doors, lift gates, trunk lids or engine hoods. Such a motor vehicle door may generally be designed as a sliding door as well.

In such a motor vehicle lock in the closed position, the lock latch is in a holding engagement with the lock striker. In such a state, the lock latch is pre-stressed in the opening direction, that is in a direction of movement to release the lock striker. Even though this pre-stress, generally stemming from a dedicated spring and/or from sealing of the associated door, is usually quite high, the pawl is in an engagement position with the lock latch in that state and exerts a blocking force by means of a blocking engagement on the lock latch, thereby preventing movement of the lock latch in the opening direction. Thus, the lock latch remains in holding engagement with the lock striker.

Eventually, the motor vehicle door is to be opened. When the pawl is then deflected into its release position, there is a sudden release of the spring and/or the sealing pre-stressing the lock latch in the opening direction. This sudden release of the high pre-stress force results in a loud, bang-like noise, which is unpleasant to hear.

Moreover, during a closing operation of the motor vehicle lock, the lock latch is moved in the closing direction, generally until it reaches the main latching position. To limit a substantial overlifting, i.e. a movement of the lock latch beyond the main latching position, generally an end stop is provided. When there is a fast closing operation of the motor vehicle lock, there may be a loud and annoying impact with this end stop. On the other hand, there may also be a noise when the lock latch moves back from a potential slight overlift for engagement with the pawl.

Thus, generally with regard to movement of the lock latch, for avoiding or mitigating the above effects it is desired that such movement of the lock latch not be excessively fast.

To this end, it is known from the prior art and in particular from DE 20 2012 011 372 U1, from which the present invention proceeds, to provide a braking arrangement which engages the lock latch in order to exert a desired braking force acting against movement of the lock latch. However, this braking arrangement presents an additional structure within the motor vehicle lock.

SUMMARY

Some embodiments of the invention to relate to providing a motor vehicle lock with an improved and in some cases more economical braking mechanism for the lock latch.

Some aspects of the invention are based on the realization that, for motor vehicle locks with a lock striker bracket, i.e.

a lock striker arrangement comprising two bars moving relative to the lock latch, a braking arrangement with a contact surface can be provided for, which exerts a contact force acting between the lock latch and the frame bar—i.e. that lock striker bar not received by the lock latch, as opposed to the latch bar which is received by the lock latch. This contact force provides a braking force against movement of the latch. Embodiments of the invention can make use of a component of the lock striker which has hitherto been neglected for the opening and closing operation of the motor vehicle lock, namely that part of the lock striker not received by the lock latch.

By acting against e. g. movement of the lock latch toward the open position from a main latching position, the force which needs to be exerted by the pawl in order to hold the lock latch in the main latching position can be reduced, thereby "relieving" the pawl to a certain extent. Further, it becomes possible not only to reduce the noise caused e.g. by the deflection of the pawl in the release position, but also to affect different frequencies of the noise in a specific manner based on the properties of the braking arrangement.

The above braking force may at least partly or even substantially be a frictional force according to an embodiment. It may as well at least partly or even substantially be a vector component of the contact force, which vector component acts against movement of the lock latch.

In various embodiments, during the closing cycle or the opening cycle of the motor vehicle lock, respectively, there is a gliding movement across the contact surface. When there is friction, each such movement has to traverse a path acting against that friction. The absorption of the impact energy during the closing cycle or the release of the spring in the opening cycle is protracted at least throughout the time for this traversal.

An embodiment provides for different regions of the contact surface being configured to exert different levels of braking forces. Thereby, a specific desired braking behavior may be provided for by the contact surface. In particular, a part of the contact surface may have a protrusion which exerts an even greater braking force acting against the movement of the lock latch.

A braking arrangement exerting a braking force that acts on the frame bar may also obviate the need for a separate structure against overlifting, is described herein.

An embodiment is directed at a braking element configured to be compressed for exerting a restoring force, which restoring force may then contribute to the contact force and as a result to the braking force. By having varying degrees of range of spring as the contact surface is traversed, a specific desired behavior of the opening and closing process can be implemented.

In order to reduce the—external—retaining force exerted on the lock latch which is transmitted through the motor vehicle door, an embodiment provides for having at least part of the flux of force of the retaining force exerted on the latch bar being closed through the frame bar. Thus, the external stress in the motor vehicle door caused by holding the lock latch in the holding engagement with the latch bar is mitigated.

In principle, the braking arrangement can be arranged either on the side of the lock latch, on the side or the frame bar or even independently of either structure. An embodiment is directed at having the braking arrangement arranged on the side of the lock latch and some embodiments are directed at having the braking arrangement arranged on the side of the frame bar.

In one embodiment, a motor vehicle lock, wherein a lock latch, a pawl, which is assigned to the lock latch, and a lock striker bracket, which lock striker bracket comprises a latch bar and a frame bar, are provided, wherein the lock latch can be brought into an open position and into at least one latching position, wherein the lock latch, when in one of the latching positions, is or may be brought into holding engagement with the latch bar, wherein a closing cycle of the motor vehicle lock comprises moving the lock latch from the open position to the at least one latching position, wherein the pawl may fall into at least one engagement position, in which it is in blocking engagement with a preliminary latching detent or a main latching detent of the lock latch for blocking the lock latch in its preliminary latching position or its main latching position, wherein the pawl may be deflected into at least one release position, in which it releases the lock latch, wherein the motor vehicle lock comprises a braking arrangement arranged such that a contact surface of the braking arrangement can be brought into a braking engagement with a counterpart such that a contact force exerted by the contact surface provides a braking force against movement of the lock latch, wherein the braking force is acting between the lock latch and the frame bar, is provided.

In an embodiment, the braking force at least partly is a frictional force exerted by the contact surface against the counterpart.

In an embodiment, the braking arrangement is arranged such that the contact surface of the braking arrangement is in a braking engagement when the lock latch is in a frame bar engagement position, such as one of the latching positions, in particular, that the braking force acts against the lock latch moving from the frame bar engagement position, such as toward the open position and/or opposite to the open position.

In an embodiment, the braking arrangement is arranged such that there is a closing gliding movement of the counterpart across the contact surface during a closing cycle in which the lock latch is brought into holding engagement with the latch bar.

In an embodiment, an opening cycle of the motor vehicle lock comprises moving the lock latch to the open position for releasing the latch bar and that the braking arrangement is arranged such that there is an opening gliding movement of the counterpart across the contact surface during the opening cycle.

In an embodiment, the contact surface comprises a first region configured to exert a first braking force when engaging the counterpart and a second region configured to exert a second braking force when engaging the counterpart, in particular during the closing gliding movement and/or the opening gliding movement, and that the second braking force is greater than the first braking force. In further embodiments, the first region comprises a substantially planar section and the second region comprises a protruding section.

In an embodiment, contact between the contact surface and the counterpart is established during the closing cycle when the lock latch moves into the at least one latching position with a holding engagement with the latch bar.

In an embodiment, the braking arrangement is configured to block movement of the lock latch beyond a limit position, in particular to block an overlifting of the lock latch, in a direction of movement of the closing cycle through the braking force.

In an embodiment, the braking arrangement comprises an elastic braking element configured to be compressed when the contact surface is brought into the braking engagement with the counterpart, such that the contact force comprises a restoring force exerted by the contact surface against the counterpart, in particular, that the contact surface comprises a section with a greater range of spring of the elastic braking element and a section with a smaller range of spring of the elastic braking element.

In an embodiment, when the lock latch is in the at least one latching position, such as in the frame bar engagement position, with a holding engagement with the latch bar, a corresponding rest point of engagement of the contact surface with the counterpart has a locally minimal range of spring.

In an embodiment, a flux of force of at least a part of a retaining force exerted by the lock latch on the latch bar is closed through the contact surface and the frame bar through the braking engagement.

In an embodiment, the braking arrangement is fixedly arranged at the lock latch, such that the frame bar comprises the counterpart.

In an embodiment, the braking arrangement is arranged at an edge of the lock latch which moves into an inlet path of the latch bar during the closing cycle of the motor vehicle lock.

In an embodiment, the braking arrangement is fixedly arranged at the frame bar, such that the lock latch comprises the counterpart.

In an embodiment, the counterpart is arranged at an edge of the lock latch which moves into an inlet path of the latch bar during the closing cycle of the motor vehicle lock.

BRIEF DESCRIPTION OF THE FIGURES

In the following the invention will be described with reference to exemplary embodiments shown in the drawings. The respective figures of the drawings show in FIG. 1 a motor vehicle lock according to a first embodiment of the invention with the lock latch in an open position, FIG. 2 the motor vehicle lock of FIG. 1 with the lock latch in a preliminary latching position, FIG. 3 the motor vehicle lock of FIG. 1 with the lock latch in a main latching position, FIG. 4 a motor vehicle lock according to a second embodiment of the invention with the lock latch in an open position, FIG. 5 the motor vehicle lock of FIG. 4 with the lock latch in a preliminary latching position, FIG. 6 the motor vehicle lock of FIG. 4 with the lock latch in a main latching position, FIG. 7 a motor vehicle lock according to a third embodiment of the invention with the lock latch in an open position, FIG. 8 the motor vehicle lock of FIG. 7 with the lock latch in a preliminary latching position, and FIG. 9 the motor vehicle lock of FIG. 7 with the lock latch in a main latching position.

DETAILED DESCRIPTION

Figure 1:
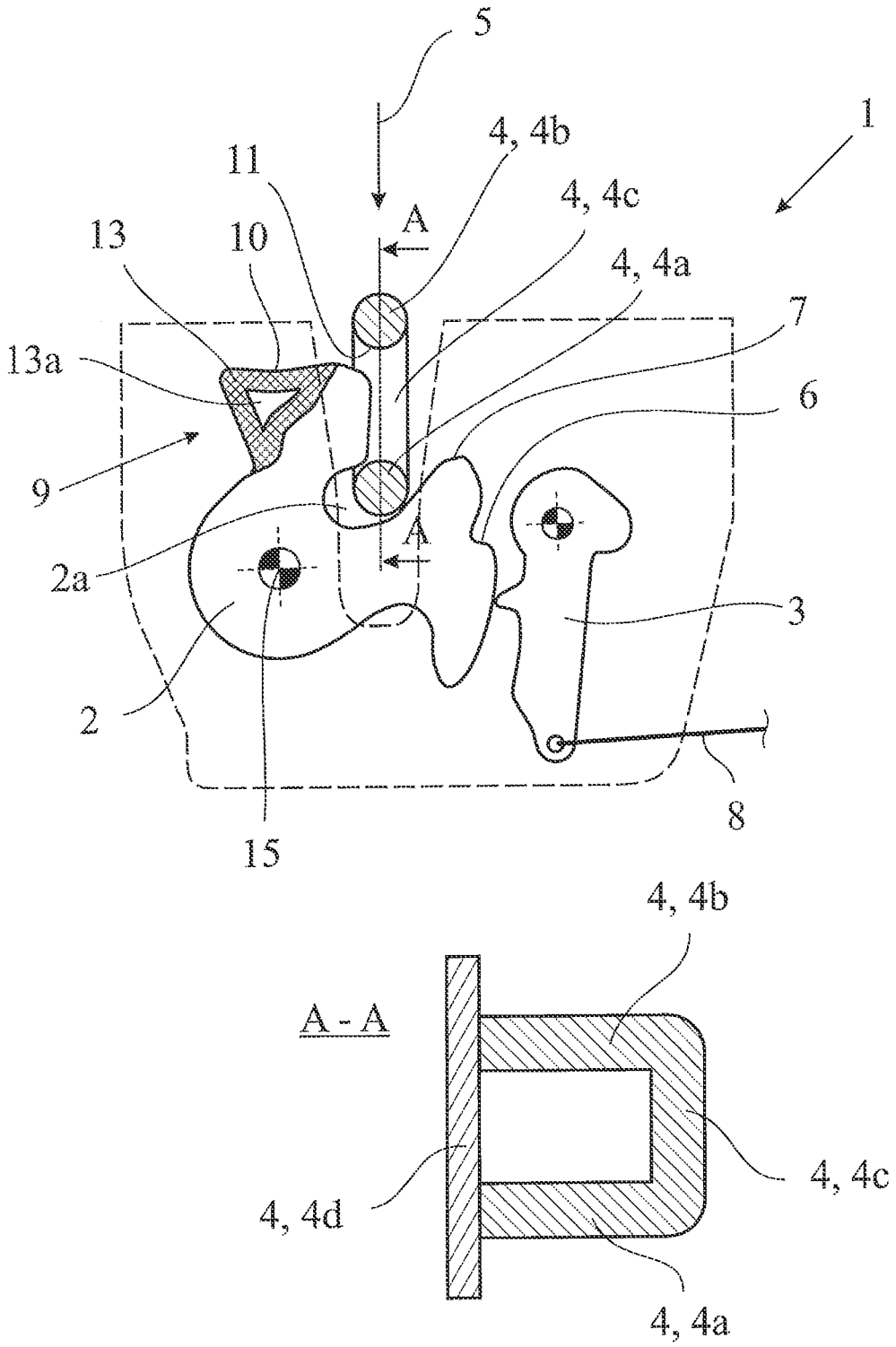

The motor vehicle locks 1 shown in the drawings are each assigned to a motor vehicle door (not shown). Regarding the broad interpretation of the expression "motor vehicle door", reference is made to the introductory part of the specification. Here the motor vehicle door is a side door of the motor vehicle.

The motor vehicle lock 1 comprises the usual locking elements lock latch 2, pawl 3—which pawl 3 is assigned to the lock latch 2—and a lock striker bracket 4 comprising a latch bar 4*a* and a frame bar 4*b*. The lock striker bracket 4 also comprises a transverse bar 4*c* fixedly coupling the latch bar 4*a* and the frame bar 4*b*, which transverse bar 4*c* is shown in FIG. 1 only. Normally, the latch bar 4*a* and the frame bar 4*b* are connected to a base plate 4*d* also shown in FIG. 1.

Figure 2:
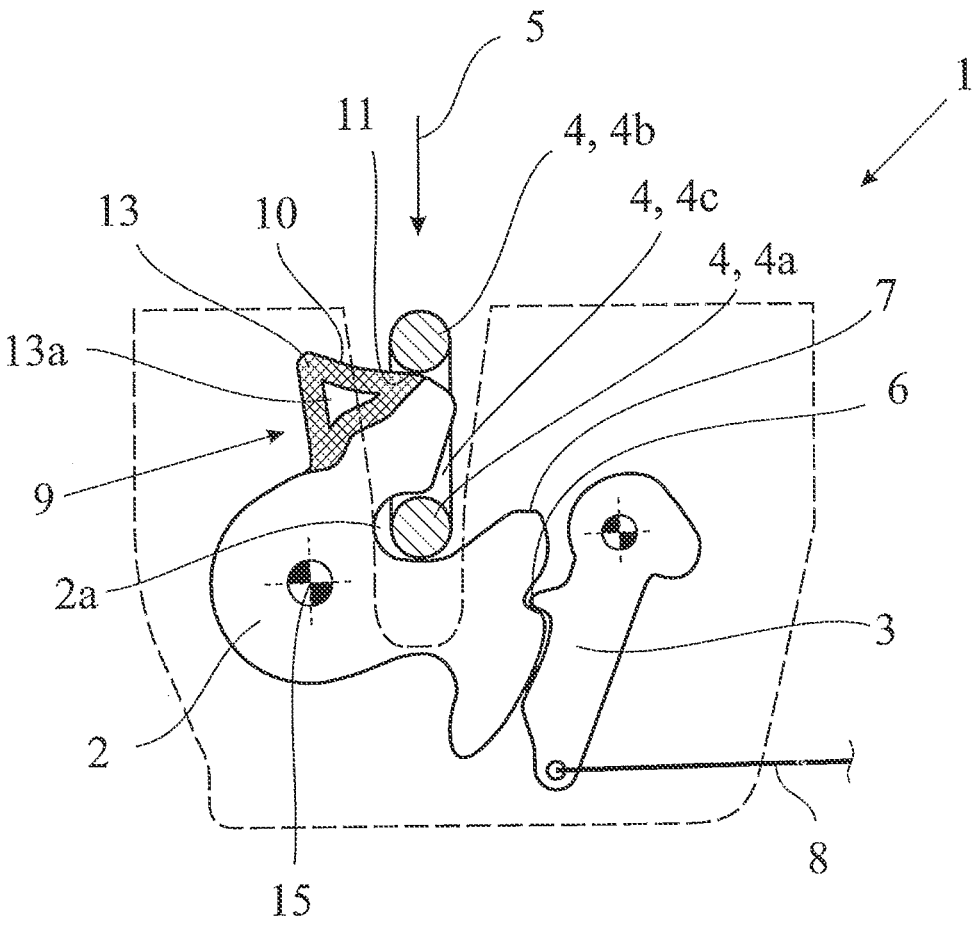
Figure 3:
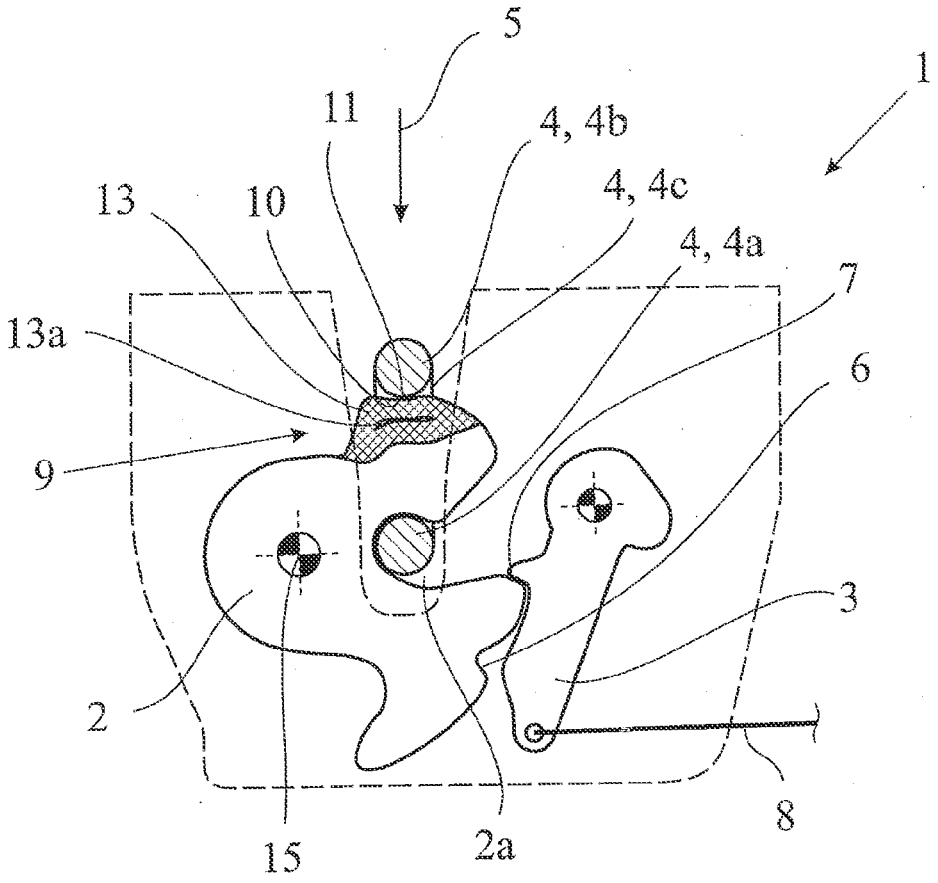
Figure 5:
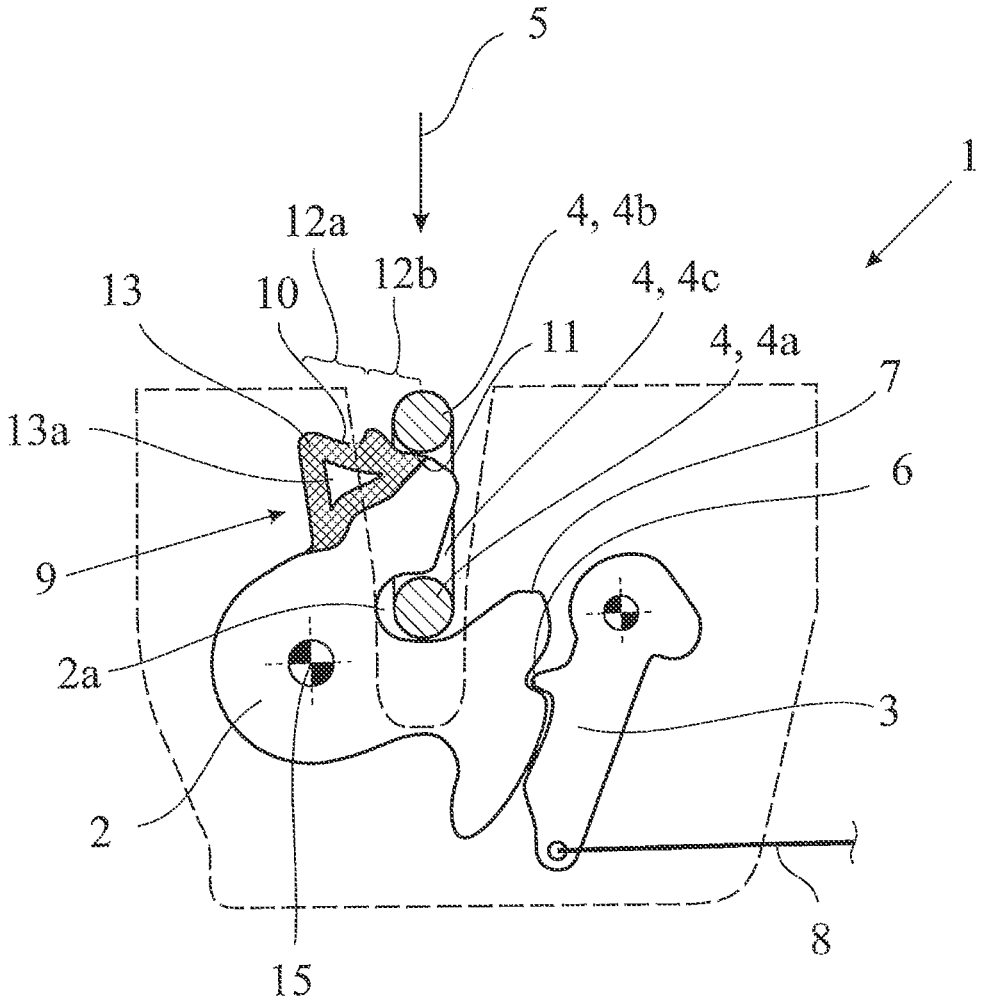
Figure 6:
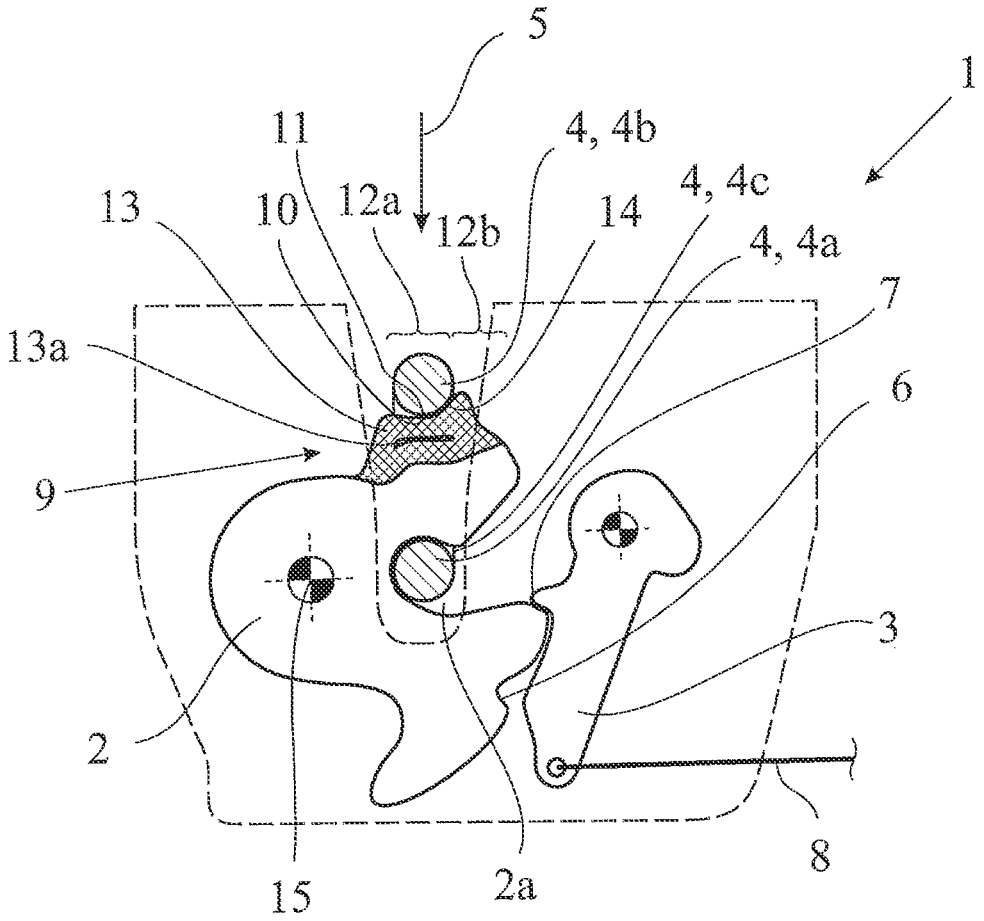
Figure 8:
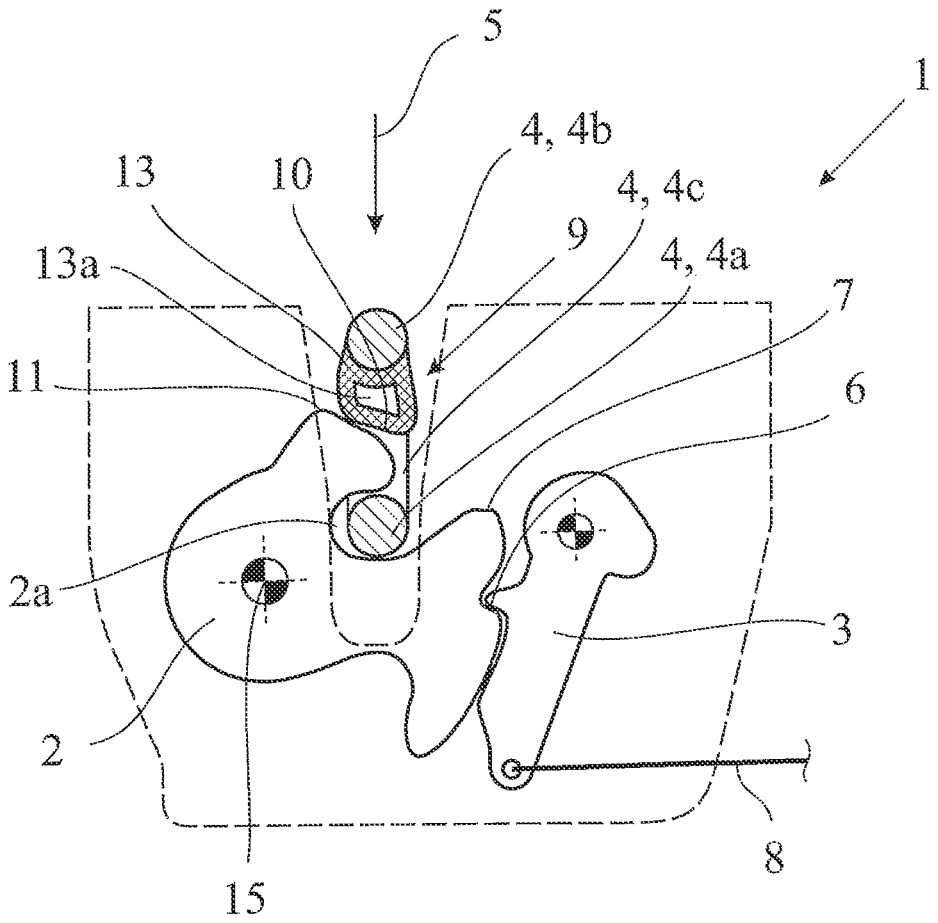
Figure 9:
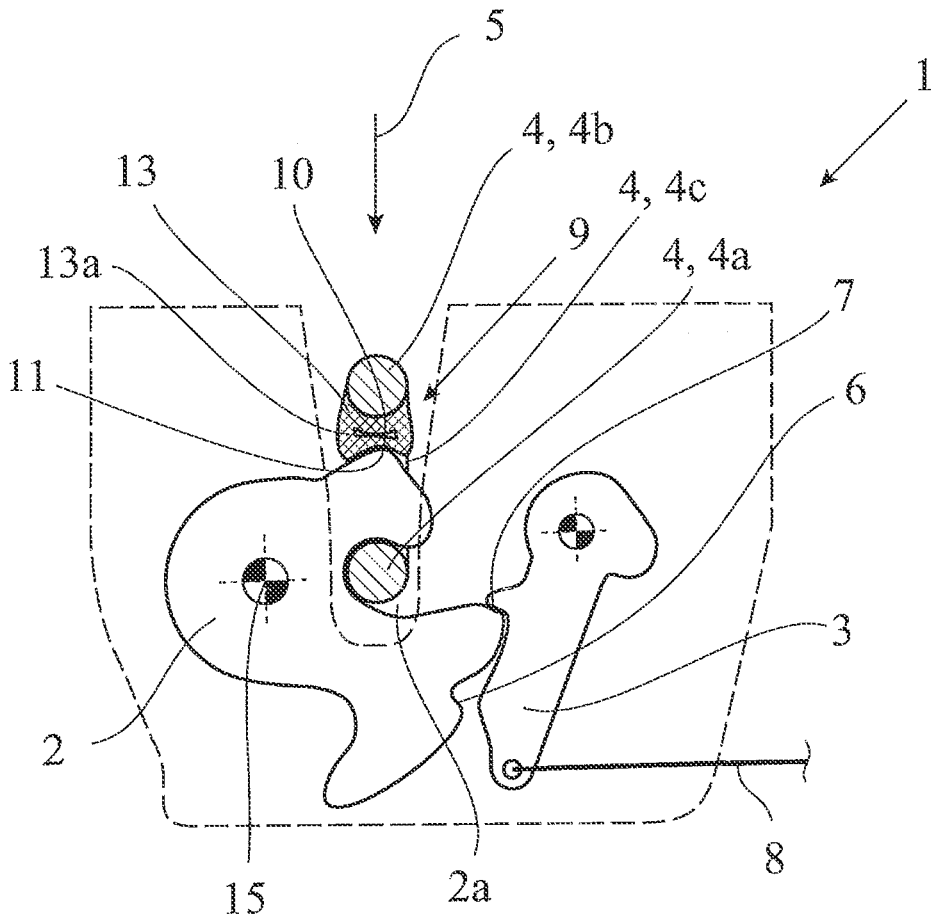

In general, the latch bar 4*a*, the frame bar 4*b* and the transverse bar can be of one piece. The lock latch 2 can be brought into an open position (FIGS. 1, 4 and 7) and into at least one latching position, which for the present embodiments comprises a preliminary latching position (FIGS. 2, 5 and 8) and a main latching position (FIGS. 3, 6 and 9). The lock latch 2, when in one of the latching positions (FIG. 2, 3, 5, 6, 8, 9), is or may be brought into holding engagement with the latch bar 4*a*. For this the latch bar 4*a* is or may be positioned in an inlet opening 2*a* of the lock latch 2, while the frame bar 4*b* stays outside the inlet opening 2*a*.

Figure 4:
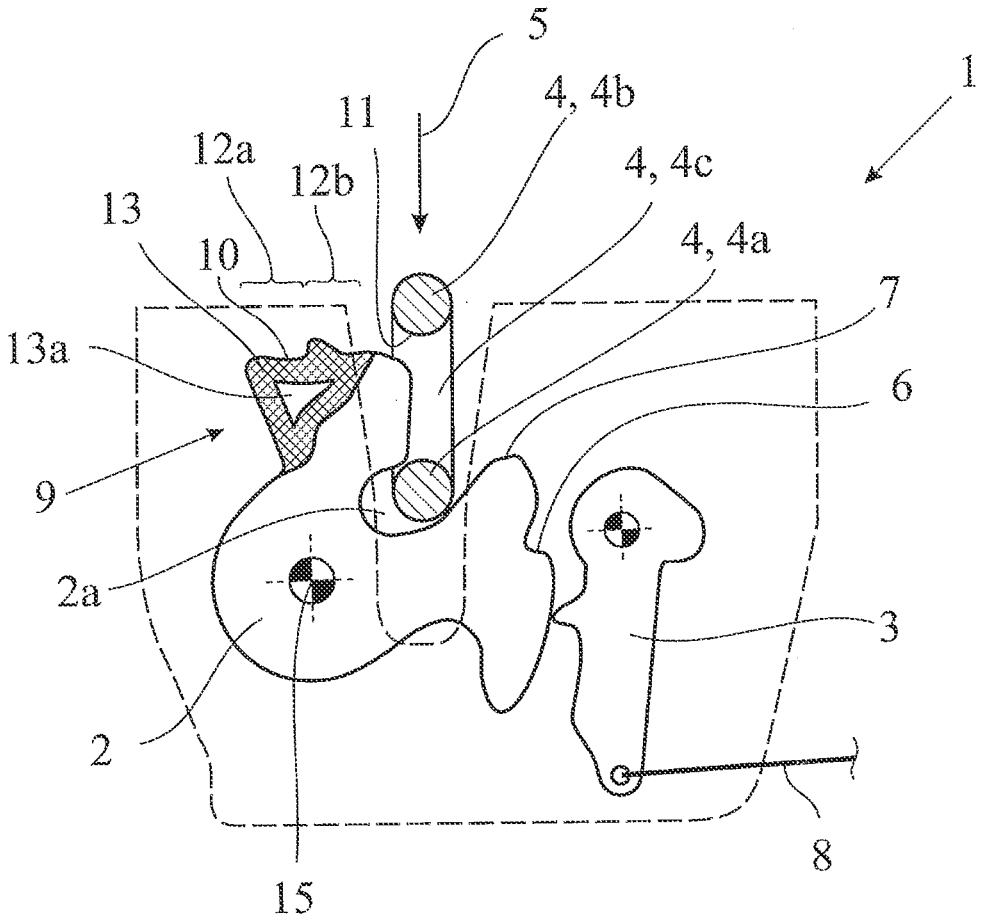
Figure 7:
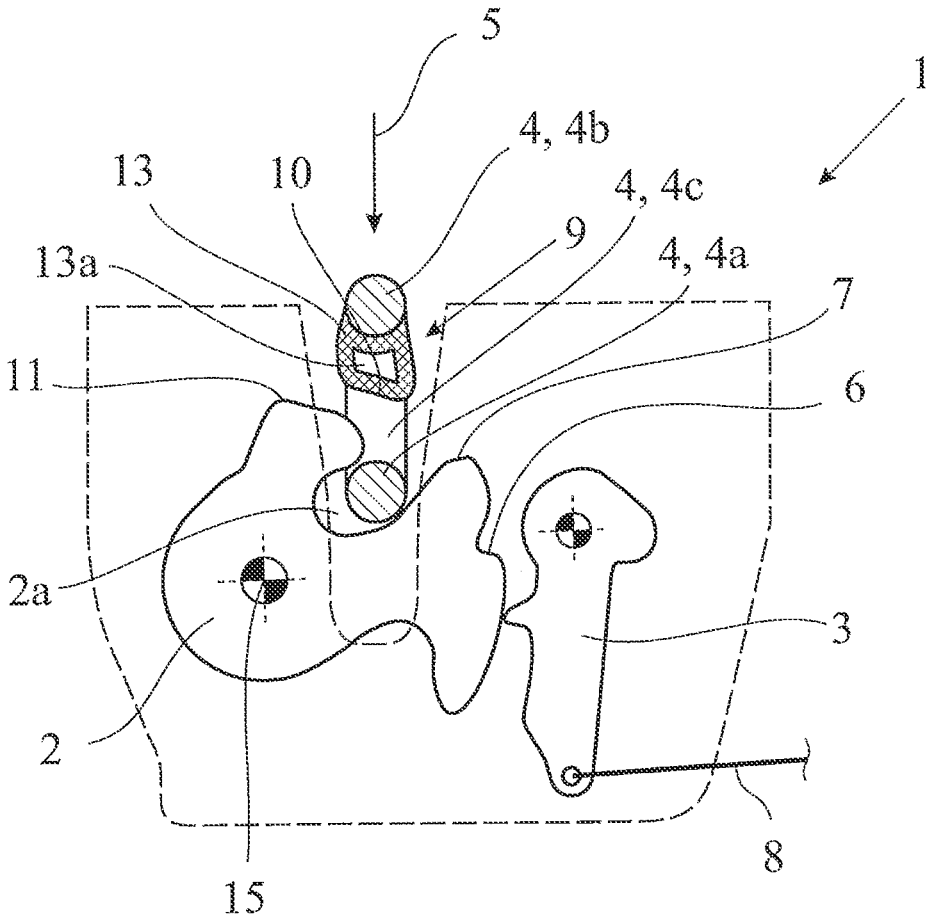

A closing cycle of the motor vehicle lock 1 is initiated by the latch bar 4*a* coming into engagement with the lock latch 2 when the motor vehicle door is being closed by the user (FIGS. 1, 4 and 7). The direction of travel of the latch bar 4*a* is denoted by reference number 5 in the drawings. It may be taken from this that during a closing cycle the frame bar 4*b* follows the latch bar 4*a*.

The above noted closing cycle of the motor vehicle lock 1 comprises moving the lock latch 2 from the open position (FIGS. 1, 4 and 7) to the at least one latching position—for the present embodiments the main latching position (FIGS. 3, 6 and 9)—, wherein the pawl 3 may fall into at least one engagement position, in which it is in blocking engagement with a preliminary latching detent 6 or a main latching detent 7. In the present embodiments the movement to the main latching position occurs via the preliminary latching position (FIGS. 2, 5 and 8). The engagement between the pawl 3 and the preliminary latching detent 6 or the main latching detent 7 leads to blocking the lock latch 2 in its preliminary latching position or in its main latching position, respectively.

For opening the motor vehicle door, the pawl 3 may be deflected into at least one release position (FIGS. 1, 4 and 7), in which it releases the lock latch 2. For performing such a deflection movement, a pawl actuation apparatus 8, in particular a pawl actuation lever—which is not shown for the present embodiments—may be provided.

The motor vehicle lock 1 further comprises a braking arrangement 9 arranged such that a contact surface 10 of the braking arrangement 9 can be brought into a braking engagement with a counterpart 11 such that a contact force exerted by the contact surface 10 provides a braking force against movement of the lock latch 2. The counterpart 11 can in principle be any surface with which the contact surface 10 can be brought into engagement, examples of which will be described in further detail below. In particular, the above contact force provides a braking force against movement of the lock latch 2 relative to the position of the braking engagement of the contact surface 10 with the counterpart 11.

The movement of the lock latch 2 is—as seen in the drawings—a rotational movement. Further, the braking force may act against movement of the lock latch 2 in both of the directions of rotation of the lock latch 2 or against movement in only either one of the directions of rotation of the lock latch 2. Whether or not the braking force against movement in both directions or only against movement in one direction may also depend on the current position of the lock latch 2 and the relative position of the frame bar 4*b* to it.

The motor vehicle lock 1 according to the invention is characterized in that the braking force is acting between the lock latch 2 and the frame bar 4*b*. This means that the braking force is in any case transmitted through the frame bar 4*b*. For this, it is not necessary that the contact surface 10 engages the frame bar 4*b* directly, though that may be the case as shown in FIGS. 1 to 6 for the first and second embodiments. It may also be that the braking force is acting on the frame bar 4*b* indirectly. This is the case for example for the third embodiment of FIGS. 7 to 9.

In an embodiment, the braking force comprises a frictional force exerted by the contact surface 10 against the counterpart 11. This frictional force may be due to static friction or due to kinetic friction at different times.

In principle, the contact surface 10 can be brought into the braking engagement 9 for one or more arbitrary positions of the lock latch 2. In an embodiment, the braking arrangement 9 is arranged such that the contact surface 10 of the braking arrangement 9 is in a braking engagement when the lock latch 2 is in a frame bar engagement position, which in other words is a specific position of the lock latch 2. There may also be more than one such frame bar engagement position. Here the frame bar engagement position is one of the latching positions. For the present embodiments, the braking arrangement 9 is arranged such that the contact surface 10 of the braking arrangement 9 is in a braking engagement when the lock latch 2 is in the preliminary latching position (FIGS. 2, 5 and 8) or in the main latching position (FIGS. 3, 6 and 9).

Accordingly, in various embodiments the braking force acts against the lock latch 2 moving from the frame bar engagement position and in particular, that the braking force acts against the lock latch 2 moving toward the open position and/or opposite to the open position. This may also be different for different frame bar engagement positions. Further, even if the braking force acts against movement of the lock latch 2 in both directions, the magnitude of the braking force may be different for both directions. For example, it can be seen for the first embodiment in FIG. 2 that when the lock latch 2 is in the preliminary latching position, the engagement between the contact surface 10 and the counterpart 11 is such that the braking force substantially acts only against movement of the lock latch 2 opposite to the open position, i.e. in a closing direction.

Further, in various embodiments the braking arrangement 9 is arranged such that there is a closing gliding movement of the counterpart 11 across the contact surface 10 during a closing cycle in which the lock latch 2 is brought into holding engagement with the latch bar 4*a*. Such a closing gliding movement against the contact force providing the braking force leads to the absorption of energy. As can be seen from FIGS. 1 to 9, in particular when considering the progression from the open position to the main latching position, this is realized for all three embodiments shown in the drawings.

Conversely, in various embodiments an opening cycle of the motor vehicle lock 1 comprises moving the lock latch 2 to the open position for releasing the latch bar 4*a* and that the braking arrangement 9 is arranged such that there is a opening gliding movement of the counterpart 11 across the contact surface 10 during the opening cycle. This is also realized for all embodiments shown here and substantially corresponds to a progression opposite to the closing cycle. Thus, there is also the above-described absorption of energy when the motor vehicle lock 1 traverses an opening cycle.

The braking arrangement 9 and in particular the contact surface 10 may be formed and in particular shaped to achieve a specific desired behavior. For example, it may be desirable to have different braking forces, i.e. greater or smaller braking forces, acting against movement of the lock latch 2. Therefore, the contact surface 10 can comprise a first region 12*a* configured to exert a first contact force when engaging the counterpart 11 and a second region 12*b* configured to exert a second contact force when engaging the counterpart 11 and that the second contact force is greater than the first contact force. In particular, this first contact force and second contact force, respectively, may be exerted during the closing gliding movement and/or the opening gliding movement.

There are in principle many options for providing such a first region 12*a* and a second region 12*b*, for example by choosing specific and varying materials or coatings for the contact surface 10 or by providing for a particular geometry of the braking arrangement 9 or the contact surface 10. As seen in the second embodiment of FIGS. 4 to 6, it may be that the first region 12*a* comprises a substantially planar section and the second region 12*b* comprises a protruding section.

In the open position of the lock latch 2, there will in general be no contact between the contact surface 10 and the counterpart 11. In principle, such contact may be established at an arbitrary point in the closing cycle of the motor vehicle lock 1. In some embodiments, contact between the contact surface 10 and the counterpart 11 is established during the closing cycle when the lock latch 2 moves into the at least one latching position with a holding engagement with the latch bar 4*a*. This situation can be seen in FIGS. 2, 5 and 8, in which the lock latch 2 is in the respective preliminary latch position and the above contact is initially made.

For a motor vehicle lock 1, it is also desired to limit in particular substantial movement of the lock latch 2 beyond the main latching position. Such excessive movement of the lock latch 2 is called overlifting. One possibility to limit this overlifting is to provide a stopping arrangement which blocks further such movement of the lock latch 2. According to an embodiment, the braking arrangement 9 may serve this purpose, thereby obviating the need for a separate stopping arrangement. Accordingly, in some embodiments the braking arrangement 9 is configured to block movement of the lock latch 2 beyond a limit position, in particular to block an overlifting of the lock latch 2, in a direction of movement of the closing cycle through the braking force. That limit position may in particular be one of the at least one latching position and in particular the main latching position. Note that for this blocking to occur it suffices that the braking force need only be sufficient to overcome a force acting on the lock latch 2 within reasonable limits, since here only a closing force exerted by a human being is relevant in practice.

In an embodiment, the braking arrangement 9 comprises an elastic braking element 13 configured to be compressed when the contact surface 10 is brought into the braking engagement with the counterpart 11. In an embodiment, the contact force goes back on a restoring force of the elastic brake element 13 exerted by the contact surface 10 against the counterpart 11. In particular, this braking element 13 may be bounded by the contact surface 10, as can be seen in FIGS. 1 to 9 for all three embodiments. As can also be seen for all three embodiments, the braking element 13 may surround an inner hollow space 13*a*, which may either be empty or filled with a different material different from that of the braking element 13. It is further to be noted that a protrusion of the contact surface 10 as described above is suitable for increasing both the frictional force and the restoring force in the section in which the protrusion is present.

It may be advantageous in view of the reduction of wear, that the braking force substantially is a vector component of the restoring force. The frictional force then only contributes a small portion to the braking force.

Here, however, that the braking force is substantially determined by the frictional force, such that extensive dynamic effects like extensive vibration tendencies, that may go back on the elasticity of the elastic braking element 13, are prevented. Here, the braking force may still comprise a restoring force component, but this restoring force component is then in any case smaller than the frictional force. It is to be noted that this respective preponderance of either the frictional force or the restoring force may be different for different positions of the lock latch 2, i.e. for different contact situations between the contact surface 10 and the counterpart 11.

In particular for achieving the above-described difference between the first contact force and the second contact force, the spring characteristics, in particular the spring elasticity, associated with particular sections of the contact surface, in particular associated with particular sections of the elastic braking element 13, may be different. For example, the contact surface 10 may comprise a section with a greater range of spring of the elastic braking element 13 and a section with a smaller range of spring of the elastic braking element 13. Here the above first region 12*a* may correspond to the section with the smaller range of spring and the above second region 12*b* may correspond to the section with the greater range of spring. It is to be pointed out that increasing the range of spring may not only affect the restoring force, but also the frictional force, even if the material properties of the braking element 13 remain the same otherwise.

It may be desired that the contact surface 10 is configured such that the braking force for moving away from a particular position of the lock latch 2 is substantially maximized, i.e. not maximized in a strict mathematical sense but chosen as great as possible within reasonable and practical limits. This may apply for example to the main latching position, because for the main latching position an overlifting as described above is to be limited on the one hand and the initial movement in the opening direction can be slowed down to prevent e.g. annoying banging noise. Therefore, in some embodiments when the lock latch 2 is in the at least one latching position—in particular in the frame bar engagement position, which here is the main latching position—with a holding engagement with the latch bar 4*a*, a corresponding rest point 14 of engagement of the contact surface 10 with the counterpart 11 is such that the braking force against a movement out of this rest position of the lock latch 2 is substantially maximized. Here, a corresponding rest point 14 of engagement of the contact surface 10 with the counterpart 11 has a locally minimal range of spring.

Since the frame bar 4*b* is fixedly connected to the latch bar 4*a* and regularly made of a single piece with the latch bar 4*a*, it becomes possible to arrange for a closed flux of force through the lock striker bracket 4 with these components, the lock latch 2 and the braking arrangement 9. Though the contact force will generally be insufficient to obviate the need for the pawl 3 entirely, thereby not eliminating the force being transmitted through in particular a bearing 15 of the lock latch 2, at least that force can be reduced, which in turn results in less stress for components of the motor vehicle door supporting the motor vehicle lock 1 and in particular the lock latch 2. In various embodiments, a flux of force of at least a part of a retaining force exerted by the lock latch 2 on the latch bar 4*a* is closed through the contact surface 10 and the frame bar 4*b* through the braking engagement.

With regard to the arrangement of the braking arrangement 9, according to one embodiment, the braking arrangement 9 is fixedly arranged at the lock latch 2. Here, in some embodiments the frame bar 4*b* comprises the counterpart 11. This corresponds to the first and second embodiments of FIGS. 1 to 6, respectively.

In particular and as also shown in FIGS. 1 to 6, the braking arrangement 9 is arranged at an edge of the lock latch 2 which moves into an inlet path of the latch bar 4*a* during the closing cycle of the motor vehicle lock 1.

According to an embodiment, the braking arrangement 9 is fixedly arranged at the frame bar 4*b*. This corresponds to the third embodiment shown in FIGS. 7 to 9. Accordingly, in some embodiments the lock latch 2 comprises the counterpart 11. As also shown for the third embodiment, is that the counterpart 11 is arranged at an edge of the lock latch 2 which moves into the inlet path of the latch bar 4*a* during the closing cycle of the motor vehicle lock 1.

Regarding the structural design of the lock latch 2, the lock latch 2 can comprise a metallic base body which is coated with a dampening material, which in turn can be a soft-elastic plastic material with good internal damping behavior, which here and in the following shall be referred to as a first material. This first material may be a plastic material, in particular a thermoplastic polyester elastomer (TPE-E). The commercially available products Hytrel 4774, Hytrel 5225 and Hytrel 6356 from DuPont or Riteflex 677 from Ticona have proven particularly advantageous in practice. The respective Shore hardness (ISO 868, 15s) can be between 43 and 77 and in particular at 51 (Hytrel 5526).

The braking arrangement 9, and in particular the braking element 13 and the contact surface 10, may now be produced by having an appropriately greater extension of the dampening material, i.e. the first material. Thus, the braking element 13 and the contact surface 10 is comprised by a coating of the lock latch 2.

Alternatively, the braking element 13 and in particular the contact surface 10 may be made from an overmould of a second material based on the lock latch 2 with the metallic base body and the coating with the first material, which second material may be identical or different from the above first material. Alternatively, the braking element 13 and the contact surface 10 may be attached to the coating of the lock latch 2 through another method.

The invention claimed is:

1. A motor vehicle lock, wherein a lock latch, a pawl, which is assigned to the lock latch, and a lock striker bracket, which lock striker bracket comprises a latch bar and a frame bar, are provided, wherein the lock latch can be brought into an open position and into at least one latching position, wherein the lock latch, when in one of the latching positions, is configured to be brought into holding engagement with the latch bar, wherein a closing cycle of the motor vehicle lock comprises moving the lock latch from the open position to the at least one latching position, wherein the pawl is configured to fall into at least one engagement position, in which it is in blocking engagement with a preliminary latching detent or a main latching detent of the lock latch for blocking the lock latch in its preliminary latching position or its main latching position, wherein the pawl is configured deflected into at least one release position, in which it releases the lock latch, wherein the motor vehicle lock comprises a braking arrangement arranged such that a contact surface of the braking arrangement can be brought into a braking engagement with a counterpart such that a contact force exerted by the contact surface provides a braking force against movement of the lock latch, wherein the braking force is acting between the lock latch and the frame bar and that the braking arrangement is arranged such that the contact surface of the braking arrangement is in a braking engagement when the lock latch is in a frame bar engagement position, the frame bar engagement position comprising one of the latching positions.

2. The motor vehicle lock according to claim 1, wherein the braking force at least partly is a frictional force exerted by the contact surface against the counterpart.

3. The motor vehicle lock according to claim 1, wherein the braking force acts against the lock latch moving from the frame bar engagement position toward the open position and/or opposite to the open position.

4. The motor vehicle lock according to claim 1, wherein the braking arrangement is arranged such that there is a closing gliding movement of the counterpart across the contact surface during a closing cycle in which the lock latch is brought into holding engagement with the latch bar.

5. The motor vehicle lock according to claim 1, wherein an opening cycle of the motor vehicle lock comprises moving the lock latch to the open position for releasing the latch bar and wherein the braking arrangement is arranged such that there is an opening gliding movement of the counterpart across the contact surface during the opening cycle.

6. The motor vehicle lock according to claim 1, wherein the contact surface comprises a first region configured to exert a first braking force when engaging the counterpart and a second region configured to exert a second braking force when engaging the counterpart, and wherein the second braking force is greater than the first braking force.

7. The motor vehicle lock according to claim 6, wherein the first region comprises a substantially planar section and the second region comprises a protruding section.

8. The motor vehicle lock according to claim 1, wherein contact between the contact surface and the counterpart is established during the closing cycle when the lock latch moves into the at least one latching position with a holding engagement with the latch bar.

9. The motor vehicle lock according to claim 1, wherein the braking arrangement is configured to block movement of the lock latch beyond a limit position in a direction of movement of the closing cycle through the braking force.

10. The motor vehicle lock according to claim 1, wherein the braking arrangement comprises an elastic braking element configured to be compressed when the contact surface is brought into the braking engagement with the counterpart.

11. The motor vehicle lock according to claim 10, wherein when the lock latch is in the at least one latching position with a holding engagement with the latch bar, a corresponding rest point of engagement of the contact surface with the counterpart has a locally minimal range of spring.

12. The motor vehicle lock according to claim 10, wherein the contact force comprises a restoring force exerted by the contact surface against the counterpart.

13. The motor vehicle lock according to claim 10, wherein when the lock latch is in the at least one latching position in the frame bar engagement position with a holding engagement with the latch bar, a corresponding rest point of engagement of the contact surface with the counterpart has a locally minimal range of spring.

14. The motor vehicle lock according to claim 1, wherein a flux of force of at least a part of a retaining force exerted by the lock latch on the latch bar is closed through the contact surface and the frame bar through the braking engagement.

15. The motor vehicle lock according to claim 1, wherein the braking arrangement is fixedly arranged at the lock latch.

16. The motor vehicle lock according to claim 15, wherein the braking arrangement is arranged at an edge of the lock latch which moves into an inlet path of the latch bar during the closing cycle of the motor vehicle lock.

17. The motor vehicle lock according to claim 15, wherein the frame bar comprises the counterpart.

18. The motor vehicle lock according to claim 1, wherein the braking arrangement is fixedly arranged at the frame bar.

19. The motor vehicle lock according to claim 18, wherein the counterpart is arranged at an edge of the lock latch which moves into an inlet path of the latch bar during the closing cycle of the motor vehicle lock.

20. The motor vehicle lock according to claim 18, wherein the lock latch comprises the counterpart.

* * * * *